US006025764A

United States Patent [19]

Pelz et al.

[11] Patent Number: 6,025,764

[45] Date of Patent: Feb. 15, 2000

[54] INPUT COUPLING ADJUSTMENT ARRANGEMENT FOR RADIO FREQUENCY FILTERS

[75] Inventors: Dieter Pelz, Bayswater; Natalie Trembath, North Croydon, both of Australia

[73] Assignee: Alcatel Alsthom Compagnie Generale d'Electricite, Paris, France

[21] Appl. No.: 08/885,470

[22] Filed: Jun. 30, 1997

[30] Foreign Application Priority Data

Jul. 1, 1996 [AU] Australia ..... P00767

[51] Int. Cl.[7] ..... H01P 1/202; H01P 5/12

[52] U.S. Cl. ..... 333/202; 333/206; 333/134

[58] Field of Search ..... 333/202, 206, 333/207, 208, 212, 219.1, 230, 222, 126, 134

[56] References Cited

U.S. PATENT DOCUMENTS 4,821,006 4/1989 Ishikawa et al. ..... 333/202

5,389,903 2/1995 Piirainen ..... 333/203

5,731,269 3/1998 Clermont ..... 333/230 X 5,764,115 6/1998 Hattori et al. ..... 333/230 X

FOREIGN PATENT DOCUMENTS 8-222919 8/1996 Japan ..... 333/219.1

*Primary Examiner*—Seungsook Ham

*Attorney, Agent, or Firm*—Ware, Fressola, Van der Sluys & Adolphson, LLP

[57] ABSTRACT

An arrangement for adjustably coupling a radio frequency input port to a resonator element of the filter. The arrangement comprises a resilient conductor (19) which extends from the input port (15) into the electric field of a resonator element (2). The remote end of the resilient conductor resiliently abuts the point (20) of an adjustment screw (20*a*). Operating the screw moves the resilient conductor in relation to the electric field and alters the capacitive coupling between the input port and the resonator element for fine tuning the impedance match of the input to the filter.

11 Claims, 2 Drawing Sheets

INPUT COUPLING ADJUSTMENT ARRANGEMENT FOR RADIO FREQUENCY FILTERS

TECHNICAL FIELD

This invention relates to radio frequency bandpass filters that incorporate resonator elements, and in particular to an adjustable coupling arrangement for adjustably coupling the filter's input means to the filter's first resonator element to obtain optimum impedance matching between elements of the input means and elements of the bandpass filter for maximum transfer of energy.

BACKGROUND OF THE INVENTION

It is known, for example from U.S. Pat. No. 5,389,903, to couple the input means of a bandpass filter of the aforementioned type to a first co-axial resonator element via a loop of wire. One end of the loop is connected to the filters input terminal within the filter housing; the other end of the loop is connected to an internal surface of the housing. The loop inductively couples the filter's input terminal to the first resonator element.

Such a known coupling arrangement provides good coupling properties. However it is difficult to finely adjust the impedance matching particularly for filters requiring tuning over a wide range of frequencies.

In such cases adjustment may be obtained by bending the loop with a probe inserted through an aperture in the filter housing to displace the loop in relation to the adjacent resonator element, or deforms it. Using this method, fine adjustment is difficult, particularly if the area in which the loop is located is too small to allow a safe bending action, as there is a likelihood of mechanical damage during the adjustment process.

SUMMARY OF THE INVENTION

It is an object of the present invention to provide an improved coupling arrangement for coupling a bandpass filter's input means to the filter's first resonator element.

According to the invention, there is provided a radio frequency filter comprising a housing means containing at least one resonator element, an input port means and at least one output port means, said filter further including an arrangement for adjustably coupling said input port means to at least one resonator element, said arrangement comprising an elongated resilient conductor element of a predetermined dimension arranged to capacitively couple said input port means to said at least one resonator element's electric field zone, wherein said resilient conductor element is arranged to co-operate with lever means of electrical insulating material that can be manually activated by a connected actuating means mounted externally on a wall of said housing means, to move said resilient conductive element thereby adjusting capacitive coupling between said input port means and said resonator element's electric field.

The electrical properties of the coupling arrangement according to the invention are generally equivalent to, and in some cases better than those of loop coupling, while avoiding the inherent disadvantages of loop coupling.

BRIEF DESCRIPTION OF THE DRAWINGS

In order that the invention may be readily carried into effect, embodiments thereof will now be described in relation to the accompanying drawings, in which.

BEST MODE FOR CARRYING OUT THE INVENTION

Figure 1:
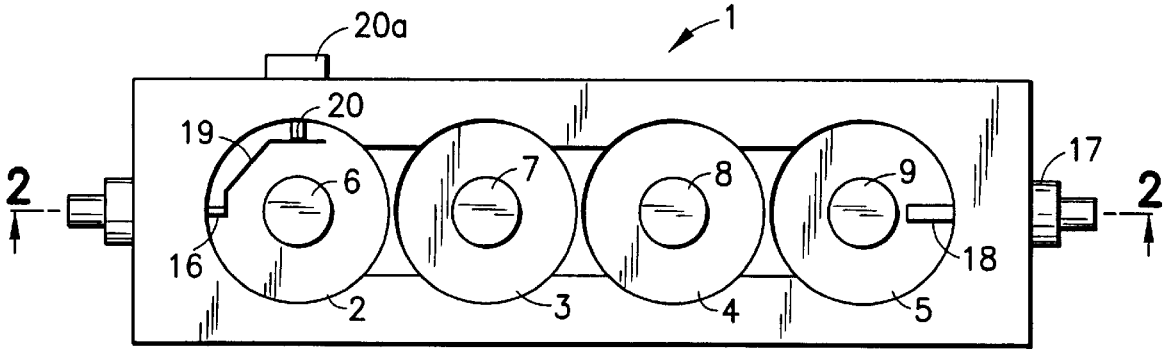
FIG. 1 shows a top view of the mechanical structure of a bandpass filter incorporating the adjustable coupling arrangement of the present invention.
Figure 2:
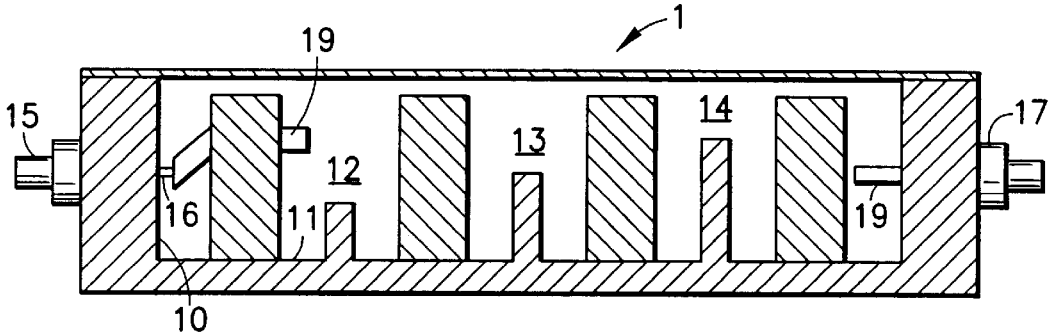
FIG. 2 shows a cross-sectional view of the mechanical structure shown in FIG. 1 taken along lines 2—2 in FIG. 1.
Figure 2A:
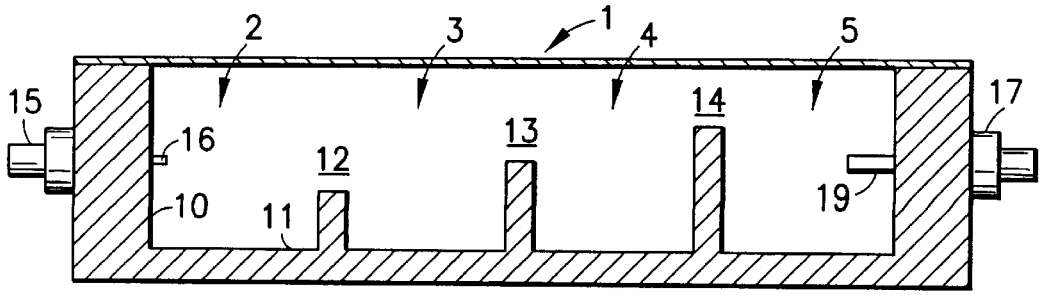
FIG. 2A is the same cross-sectional view as FIG. 2, but showing the mechanical structure without the resonator rods in place.

Referring to FIGS. 1, 2 and 2A best mode for carrying out the invention, the radio frequency bandpass filter 1 comprises a rectangular block of conductive material in which are formed four aperture coupled co-axial resonators (2, 3, 4 and 5) of predetermined dimensions, each comprising a resonator rod (6, 7, 8 and 9) within a cavity having a side wall 10, a bottom wall 11, and a top wall (not shown); the latter wall being formed by a removable plate common to all cavities. Adjacent resonators are coupled by an aperture 12, 13 and 14 in the side wall as best seen diagrammatically by the opposing arrows in FIG. 2A.

An input port 15 comprising a conductor 16 which extends into resonator 2 to couple the input port to the filter. An output port 17 comprises a conductor 18 which extends into resonator 5 to couple the filter to the output port.

From the end of conductor 16 there extends a flat resilient conductor 19 which is provided with a bend intermediate its length such that its free end resiliently abuts the point 20 of an adjustment screw 20*a* which extends into resonator 2. The shaft and point 20 of screw 20*a* are made of suitable electrical insulating material such as, for example, aluminium oxide.

Resilient conductor 19 acts electrically like a transmission line and its end section couples input port 15 to the electric field of resonator 2.

Optimum coupling is obtained by operating screw 20 to move conductor 19 in relation to resonator rod 6, and using a return loss measurement means or any other known means for measuring the reflection factor to find optimum impedance match over a given bandwidth.

Figure 3:
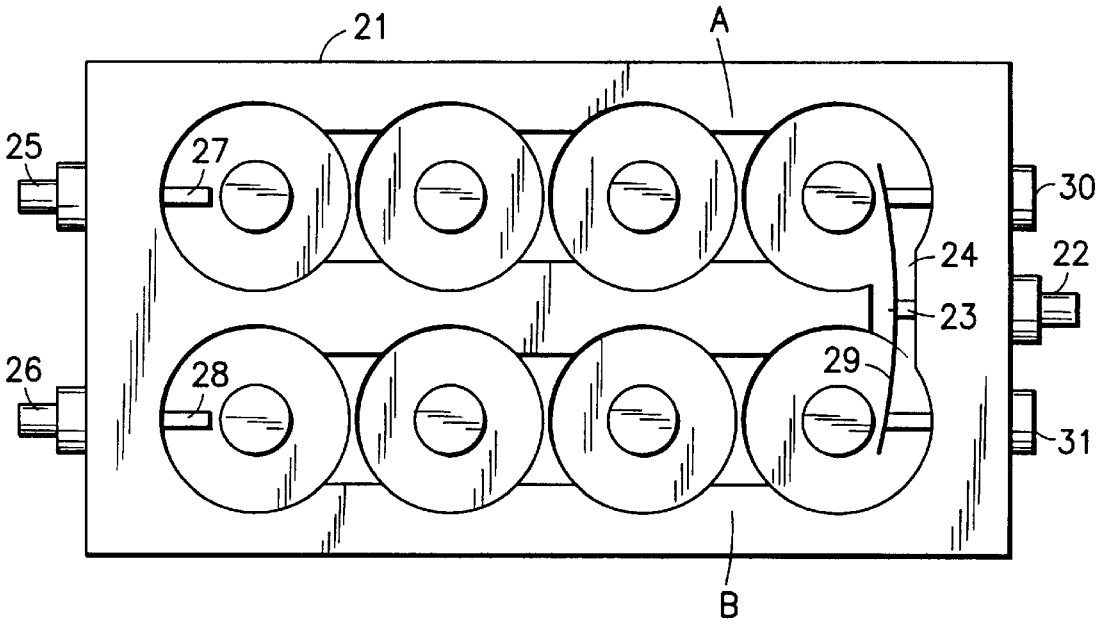
FIG. 3 shows a top view of the mechanical structure of a diplexer filter incorporating the adjustable coupling arrangement of the present invention.
Figure 4:
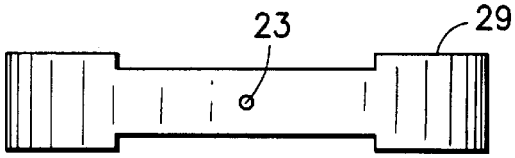
FIG. 4 shows a side view of a conductive element of the coupling arrangement shown in FIG. 3.

Referring to FIGS. 3–4, the high frequency diplexer 21 comprises a rectangular block of conductive material in which is formed a high bandpass filter A and a low bandpass filter B. Each filter comprises four aperture coupled co-axial resonators of predetermined dimensions. The resonators are similar to those described above in relation to FIGS. 1 and 2. The diplexer 21 includes a single input port 22 comprising a conductor 23 which extends into a passage 24 connecting the first resonator of filter A to the first resonator of filter B, and two output ports 25 and 26. Output port 25 comprises a conductor 27 which extends into the last resonator of filter A, and output port 26 comprises a conductor 28 which extends into the last resonator of filter B.

Conductor 23 of input port 22 is connected to a flat elongated resilient conductor 29 at a point intermediate the length of the conductor. The length of the conductor is such that each end thereof resiliently abuts the point of a respective adjustment screw 30 and 31, adjustment screw 30 extending into the first resonator of filter A and adjustment screw 31 extending out the first resonator of filter B. The shaft and point of adjustment screws 30 and 31 are made of suitable electrical insulating material such as, for example, aluminium oxide.

Optimum coupling of the input port to filters A and B is obtained by operating screws 30 and 31 to move the ends of conductor 29 in relation to the resonator rods of the first resonators, and using a return loss measurement means or any other known means for measuring the reflection factor to locate optimum impedance match between elements connected to the input port and filters A and B.

What is claimed is:

1. A radio frequency filter comprising a housing means containing at least one resonator element, an input port means and at least one output port means, said filter further including an arrangement for adjustably coupling said input port means to at least one resonator element, said arrangement comprising an elongated resilient conductor element of a predetermined dimension arranged to capacitively couple said input port means to said at least one resonator element's electric field zone, wherein said resilient conductor element is arranged to co-operate with lever means of electrical insulating material that can be manually activated by a connected actuating means mounted externally in a wall of said housing means, to move said resilient conductive element thereby adjusting capacitive coupling between said input port means and said resonator element's electric field.

2. A radio frequency filter as claimed in claim 1, wherein said resilient conductor extends from a part of the input port means such that the resilient conductor's free end resiliently abuts said lever means.

3. A radio frequency filter as claimed in claim 2, wherein said actuating means is a screw whose point forms the said lever means.

4. A radio frequency filter as claimed in claim 3, wherein said at least one resonator element is a co-axial resonator.

5. A radio frequency filter as claimed in claim 4, comprising a plurality of the co-axial resonators.

6. A radio frequency filter as claimed in claim 1, wherein said actuating means is a screw whose point forms the said lever means.

7. A radio frequency filter as claimed in claim 1, wherein said at least one resonator element is a co-axial resonator.

8. A radio frequency filter as claimed in claim 7, comprising a plurality of the co-axial resonators.

9. A radio frequency filter as claimed in claim 1, wherein said electrical insulating material is aluminum oxide.

10. A radio frequency filter comprising a housing means containing a first array of coupled resonator elements and an adjoining second array of coupled resonator elements, an input port means common to both arrays and respective output port means for each array, said filter further including an arrangement for adjustably coupling said input port means to a first resonator element in each array, said arrangement comprising an elongated resilient conductor extending from a part of said input port means to a first resonator element's electric field zone, each end portion of said resilient conductor resiliently abutting one end of a respective adjustment screw of an electrical insulating material mounted in a wall of said housing, said screws each having a screw head at its second end, each screw head located outside said housing, whereby co-operation of respective screws moves associated end portions of said resilient conductor, thereby adjusting capacitive coupling between said input port means and an associated resonator element's electric field.

11. A radio frequency filter as claimed in claim 10, wherein said electrical insulating material is aluminum oxide.

* * * * *